US005558584A

United States Patent [19]

Brown

[11] Patent Number: 5,558,584

[45] Date of Patent: Sep. 24, 1996

[54] POOL CUE WITH SIGHT

[76] Inventor: James C. Brown, 2121 Skyhawk Dr., Fort Wayne, Ind. 46815

[21] Appl. No.: 398,774

[22] Filed: Mar. 6, 1995

[51] Int. Cl.[6] ..... A63D 15/08

[52] U.S. Cl. ..... 473/44

[58] Field of Search ..... 473/44, 45, 46, 473/47, 48, 49, 2

[56] References Cited

U.S. PATENT DOCUMENTS

| | | | |
|---|---|---|---|
| 1,147,705 | 7/1915 | Cambell | 473/44 |
| 1,505,609 | 8/1924 | Seeman | 473/44 |
| 1,702,292 | 2/1929 | Barrett | 473/44 |
| 3,389,911 | 6/1968 | Castiglione | 473/2 |
| 4,688,796 | 8/1987 | Wright | 473/2 |
| 4,949,965 | 8/1990 | Ross | 473/2 |
| 5,181,718 | 1/1993 | Valentine | 473/45 |

FOREIGN PATENT DOCUMENTS

| | | | |
|---|---|---|---|
| 381766 | 10/1932 | United Kingdom | 473/44 |
| 2219517 | 12/1989 | United Kingdom | 473/2 |

*Primary Examiner*—Theatrice Brown
*Attorney, Agent, or Firm*—Roger M. Rickert

[57] ABSTRACT

A pool cue with a sight or aiming aid integrally associated therewith in the form of a narrow straight line centered along the top of the cue to be aligned with the ball, pocket in the background, or similar target. The cue is formed as two separate pieces of about the same length which screw together. The front piece is a tapered metal tube or rod terminating in the tip which strikes the ball. A cold-roll-forming machine is used to pinch the front piece together deforming the cross-section from a circle and creating a top line for sighting or alignment purposes.

10 Claims, 2 Drawing Sheets

POOL CUE WITH SIGHT

SUMMARY OF THE INVENTION

The present invention relates generally to cues of the type frequently used in table games such as pool or billiards and more especially to such a cue having a sight or aiming aid.

Aiming aids are well known for a wide variety of devices. The Ross Pat. U.S. No. 4,949,965 relates to an aiming aid for a wooden cue and shows the use of a narrow strip of wood of a dissimilar color laminated between two identical semi-cylindrical, slightly tapered halves to create a line running the length of the cue. The line is to help align the cue with the ball. U.S. Pat. No. 3,389,911 to Castiglione shows an elongated blade front sight which clamps on to a cue.

A wooden cue is subject to warpage. Further, good quality wooden cues are quite expensive. Sighting devices which are appended to the cue add weight, change the balance and feel of the cue and generally interfere with normal use.

Among the several objects of the present invention may be noted the provision of a sight on an otherwise conventional cue at an insignificant increase in the cost of the cue; the provision of a cue aiming aid which eliminates the drawbacks of known prior cue aiming aids; and the provision of a unique technique for forming a cue having an aiming aid. These as well as other objects and advantageous features of the present invention will be in part apparent and in part pointed out hereinafter.

In general, an elongated cue has a pair of adjacent elongated grooves or troughs of uniform cross-sectional configuration throughout, the troughs extending a substantial distance from a front cue end toward the other end of the cue and defining there between a peak or ridge extending in a straight line coplanar with and nearly parallel to the axis of cue elongation. The cue is generally frustoconical in shape and deviates therefrom only along the two troughs. The ridge between the troughs provides an aiming aid for a user.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
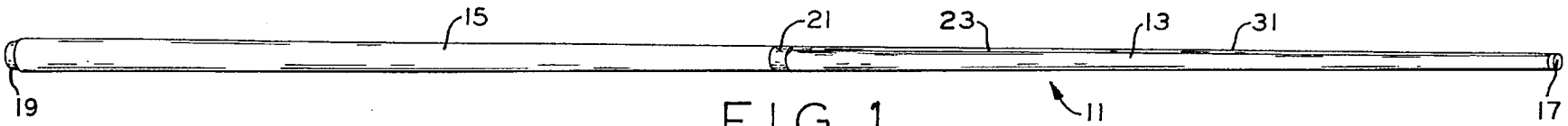
FIG. 1 is a perspective view of a pool cue illustrating my invention in one form.
Figure 2:
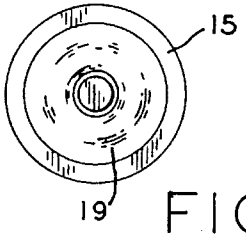
FIG. 2 is a rear end view of the cue of FIG. 1.
Figure 3:
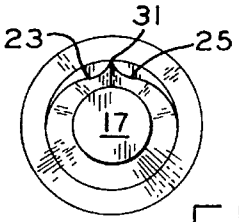
FIG. 3 is a front end view of the cue of FIG. 1.
Figure 4:
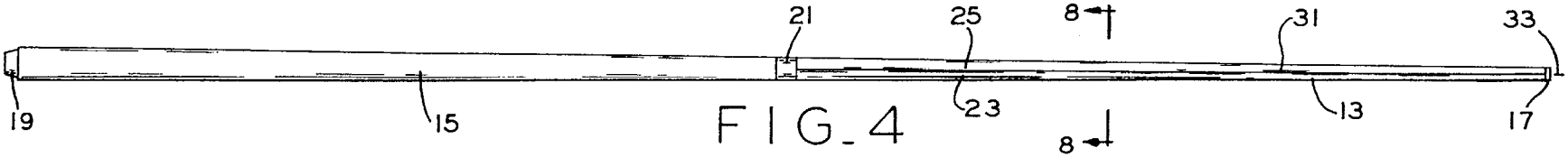
FIG. 4 is a top plan view of the cue of FIG. 1.
Figure 5:
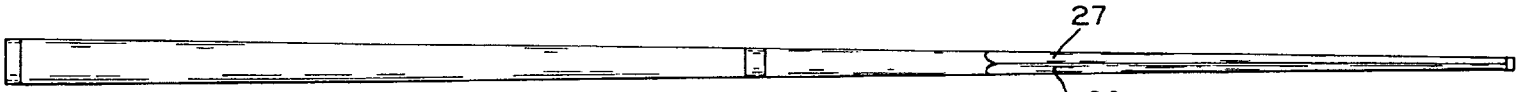
FIG. 5 is a top plan view of a cue similar to that of FIGS. 1–4, but illustrating a modified form of my invention.

In FIG. 1, an elongated metal cue 11 is formed as a pair of hollow tubular coaxial front 13 and rear 15 sections. The front section 13 terminates in a tip 17 for impacting a ball while the rear section 15 has a conventional bumper 19. The sections are threadedly Joined at 21. A pair of adjacent elongated indentations 23 and 25 extend longitudinally along a substantial portion of the length of the front section 13. In FIG. 1, these indentations run the full length of that section while in FIG. 5 the grooves 27 and 29 extend back from the tip 17 about ⅔ of the length of the front section. The grooves or indentations such as 23 and 25 define therebetween a straight line or ridge 31 which extends nearly parallel to the tube axis 33 and provides the aiming aid for a user. The tubular front section 13 is generally frustoconical in shape and departs from a frustoconical shape only along the two indentations. The ridge 31 lies on the frustoconical surface and the slight taper of the front section 13 renders the axis 33 and ridge 31 not quite parallel. This ridge, however, lie in the same plane (perpendicular to the plane of the paper in FIG. 4) as the axis 33.

Figure 6:
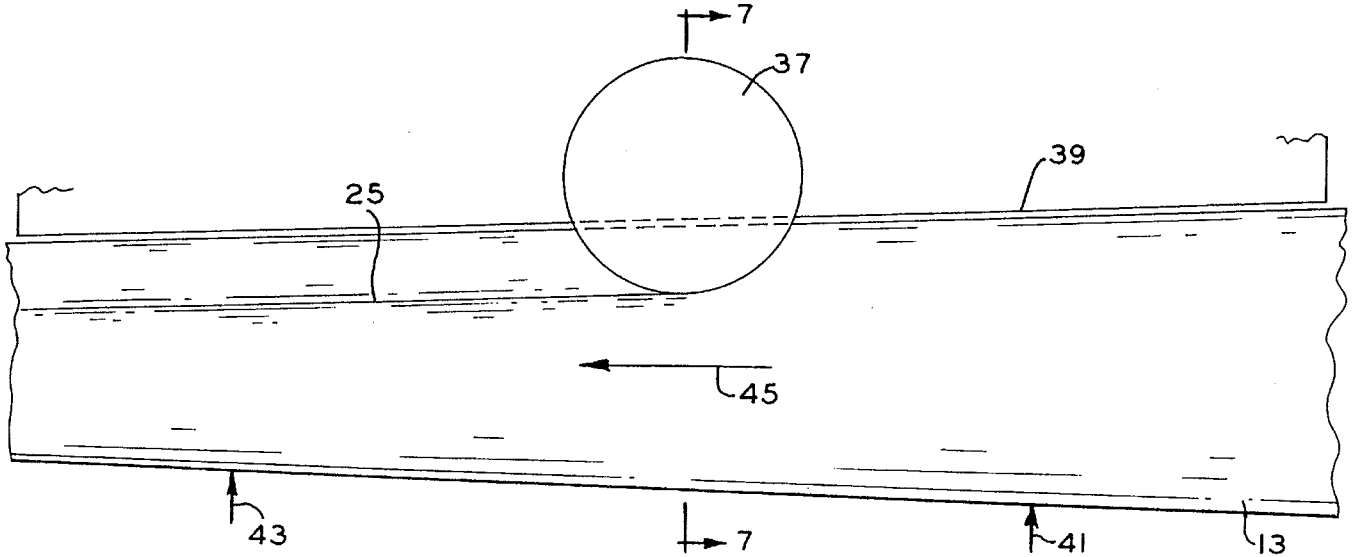
FIG. 6 is a side elevation view of a portion of a pool cue being formed according to the present invention.
Figure 7:
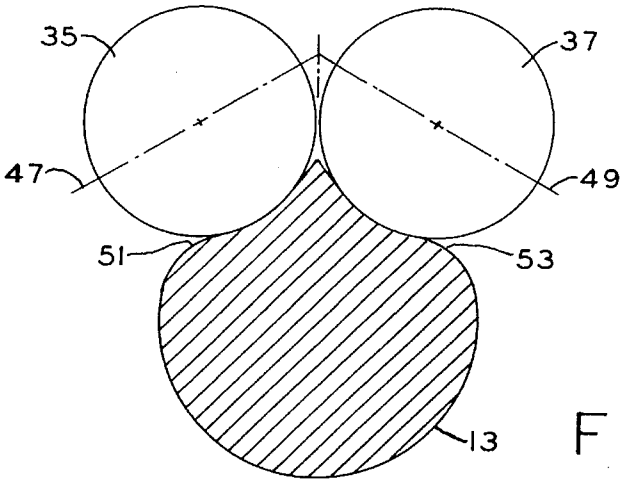
FIG. 7 is a cross-sectional view along lines 7—7 of FIG. 6.

The process of forming the adjacent grooves is shown in FIGS. 6 and 7. Other than the grooves 23, 25 (27, 29 in FIG. 5) and the ridge formed therebetween, the cue 11 may be a conventional two-piece solid or hollow elongated tubular metal cue. The front section 13 is typically aluminum, but may be a molded or extruded plastic, or laid-up fiberglass. The aiming aid may be created along a hollow or solid aluminum shaft by engaging and deforming the front cue piece 13 near one end (the front tip end as shown) with at least one, and preferably two adjacent substantially identical convex rollers 35 and 37. The rollers may be spherical as shown, or may be of some other convex surface of rotation. The convex rollers move in a straight line relative to the cue front section 13 along axis 33 in the direction of cue elongation to the other end of the front cue piece 13. As shown, the cue section 13 is forced against the fixed bed 39 of a cold-roll-forming machine and into deformation creating engagement with the rollers 37 and 35 as indicated by the arrows 41 and 43. The cue is then moved toward the left as indicated by arrow 45, and the rollers rotate about their center lines 47 and 49. Of course, the cue may be fixed and the rollers 35 and 37 moved if desired. In either case, a uniform deformation of the cue front piece occurs along substantially the entire length thereof, and this deformation of the cue front piece 13 along the pair of parallel grooves 23 and 25, which may extend substantially the entire length of the front section 13, forms between the grooves, a straight line ridge 31 which aids in aiming the cue.

Figure 8:
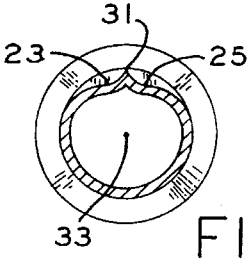
FIG. 8 is a cross-sectional view along lines 8—8 of FIG. 4.

The elongated tapered front and rear sections 13 and 15 may be hollow metal tubular members as shown in FIG. 8, or may be formed from solid aluminum rod sections as indicated in FIG. 7. When formed from solid rod sections, after passage of the ball mill as shown in FIGS. 6, and 7, a second pass of a so-called dresser tool may be needed to reshape the regions 51 and 53 to the final desired contour. One pass with a more complex roller configuration is also possible. In one preferred embodiment using solid aluminum rod sections, the front section was counterbored to receive the tip 17, and the rear section 15 was also counterbored to remove some material thereby improving the balance by shifting the center of gravity of the cue.

In summary, the invention has a number of advantages over known prior cues. A relatively inexpensive two piece cue includes an aiming aid. The aid or sighting device adds no weight and in no way interferes with conventional cue use. The aiming aid improves player performance. The aiming aid will not deteriorate with use.

From the foregoing, it is now apparent that a novel cue sighting arrangement as well as a novel technique for forming a sighting line sighting aid on a cue have been disclosed meeting the objects and advantageous features set out hereinbefore as well as others, and that numerous modifications as to the precise shapes, configurations and details may be made by those having ordinary skill in the art without departing from the spirit of the invention or the scope thereof as set out by the claims which follow.

What is claimed is:

1. An elongated cue including elongated tapered coaxial front and rear shaft sections, the front section having a pair of adjacent elongated indentations extending along a substantial portion of the length thereof and defining therebetween a straight line extending coplanar with and nearly parallel to the shaft axis to provide an aiming aid for a user, the cue front section being generally frustoconical in shape and departing therefrom only along the two indentations.

2. The cue of claim 1 wherein the cue front and rear sections are threadedly separable.

3. The cue of claim 1 wherein the indentations extend substantially the entire length of the cue front section.

4. The cue of claim 1 wherein the cue front and rear sections are hollow tubular metal sections.

5. The cue of claim 1 wherein the cue front and rear sections are solid rods.

6. An elongated cue having a pair of adjacent elongated troughs of uniform cross-sectional configuration throughout their extent, the troughs extending a substantial distance from a front cue end toward the other end of the cue and defining therebetween a peak extending in a straight line coplanar with and nearly parallel to the axis of cue elongation to provide an aiming aid for a user.

7. The cue of claim 6 wherein the cue is generally frustoconical in shape and departs therefrom only along the two troughs.

8. The cue of claim 6 formed from threadedly separable coaxial aluminum front and rear sections.

9. The cue of claim 8 wherein the front and rear sections are solid rods.

10. The cue of claim 8 wherein the front and rear sections are hollow tubular sections.

* * * * *